United States Patent [19]

Rachais

[11] 4,179,075

[45] Dec. 18, 1979

[54] VACUUM-SPRAYING GRINDER

[75] Inventor: Claude Rachais, Paris, France

[73] Assignee: Creusot-Loire, Paris, France

[21] Appl. No.: 849,981

[22] Filed: Nov. 9, 1977

[30] Foreign Application Priority Data

Nov. 23, 1976 [FR] France ..... 76 35175

[51] Int. Cl.[2] ..... B02C 19/00

[52] U.S. Cl. ..... 241/67; 241/275; 308/10

[58] Field of Search ..... 241/67, 275, 58; 308/10

[56] References Cited

U.S. PATENT DOCUMENTS

| | | | |
|---|---|---|---|
| 2,609,993 | 9/1952 | Planiol | 241/58 X |
| 2,918,223 | 12/1959 | Eppenbach | 241/67 |
| 3,567,141 | 3/1971 | Zbraniborski et al. | 241/275 |
| 3,747,998 | 7/1973 | Klein et al. | 308/10 |
| 3,873,047 | 3/1975 | Johnson | 241/275 |
| 3,877,761 | 4/1975 | Boden et al. | 308/10 |
| 3,955,767 | 5/1976 | Hise | 241/275 |
| 4,037,886 | 7/1977 | Boden et al. | 308/10 |
| 4,080,012 | 3/1978 | Boden et al. | 308/10 |

*Primary Examiner*—Mark Rosenbaum

*Attorney, Agent, or Firm*—Haseltine, Lake & Waters

[57] ABSTRACT

A vacuum-spraying grinder in which material to be ground is sprayed by centrifugal force onto an impact surface, comprising a fixed chamber connected to a suction device and housing a target having an annular inwardly directed impact surface with a vertical axis of symmetry of revolution. A rotor is located in the chamber coaxially with the impact surface of the target, and comprises an upper part located at the level of the target in the form of a horizontal disc provided with radial channels communicating with a central feed orifice in the upper part of the disc, and a lower part in the form of a vertical shaft. The shaft of the rotor is supported, driven and guided by a mechanism comprising at least one active radial magnetic bearing whose stator surrounds the shaft over a portion of its height and whose rotor is carried by the shaft, an active axial magnetic stop, radial and axial position detectors, an electric motor whose stator surrounds the shaft over a portion of its height and whose rotor is located on the shaft, and a set of ball bearings mounted around the shaft and on which the shaft rests when it is not in operation.

8 Claims, 2 Drawing Figures

VACUUM-SPRAYING GRINDER

FIELD OF THE INVENTION

The invention relates to a vacuum-spraying grinder in which the material to be ground is sprayed by centrifugal force on to an impact surface located inside a vacuum chamber.

PRIOR ART

It was proposed many years ago to construct a grinder using centrifugal force to spray the material to be ground on to a target at very high speeds, the entire device being arranged under vacuum so as to avoid braking the sprayed particles by air resistance.

Such a grinder is described, for example, in U.S. Pat. No. 2,609,993. A grinder of the type described in this patent comprises a fixed chamber connected to means of suction in order to maintain a reduced pressure in the chamber, a target which is in the form of a ring having an impact surface of revolution whose axis is substantially vertical, and a rotor comprising an upper part in the form of a disc defining radial channels, this upper part of the rotor being located at the level of the target, and a lower part in the form of an elongated shaft, for supporting, guiding and driving the rotor at very high speeds of rotation. These grinders also comprise devices for feeding the products to be ground and devices for removing the ground product located in the lower part of the fixed chamber.

In the use which has been made of these grinders for the preparation of materials for cement manufacture or for crushing minerals, the impact speeds required to obtain desirable particle sizes are generally in the range from 150 to 500 m/sec.

If it is desired to use a rotor comprising an upper part in the form of a disc which does not have an excessively large diameter, which would make the construction of the grinder very difficult, it is necessary, in order to achieve sufficient peripheral speeds of the disc in the area where the radial channels terminate, to use very high speeds of rotation of the rotor, which speeds can range up to 50,000 revolutions/minute. The difficulties associated with achieving such speeds of rotation of the rotor of the grinder are very great. It is necessary to have perfect balancing of the rotor, since the least imbalance at these speeds creates vibrations which are detrimental to good mechanical performance and to good operation of the grinder.

It is also necessary to have means for supporting and guiding the rotor shaft which produces very little friction and withstands the very high peripheral speeds of the shaft.

It is for this reason that it has hitherto been proposed to use fluid bearings, in particular hydrostatic bearings employing oil, to support and guide the rotating shaft. Nevertheless, these bearings suffer from certain disadvantages because they must be located inside the vacuum chamber, since leakproof mechanical glands cannot be used at the speeds of rotation at which the shaft is driven. Hence, there is a danger that the oil from the bearings will be introduced into the vacuum chamber.

On the other hand, at the very high peripheral speeds used, the temperature rise of the oil of the bearings is very great, which requires considerable cooling of the shaft and of the bearings. At these speeds, the friction, though reduced relative to that of mechanical bearings, is still very great and requires High power for driving the rotor.

The gain achieved with these grinders relative to conventional grinders in respect of the power consumption and the yield of the operation, which is theoretically very high, is thus reduced because of this consumption of power due to the friction in the bearings.

On the other hand, the acceptable play for hydrostatic bearings is extremely low, which requires absolutely perfect centering of the rotor and balancing, which is very difficult to ensure with a sufficient degree of precision. Furthermore, this balancing does not remain constant during the use of the grinder because the particles of material passing through the channels of the disc of the rotor cause a wear of these channels, which is not necessarily symmetrical, thereby unbalancing the rotor during use. Because the balancing of the rotor is not adjustable it is necessary to stop the installation and change the disc of the rotor. In view of the fact that very slight unbalancing of the rotor suffices to make the installation unusable, it is not possible to expect long periods of use (for example about ten hours) of the grinder without stopping the installation to change a component.

Finally, the grinder has to function in a dusty atmosphere, and the introduction of fine particles into the space between the rotor and the envelope of the bearing may cause problems which also necessitate stopping the installation.

For all these reasons, a grinder using centrifugal spraying in vacuo has hitherto not been used industrially, in spite of the theoretical advantages which it exhibits in respect of power consumption and yield, relative to conventional grinders, for example ball mills, which have a very low yield, and in spite of the advantages associated with the fact that with centrifugal spraying grinders a very fine particle size of the ground products is achieved very rapidly.

SUMMARY OF THE INVENTION

An object of the invention is to provide a vacuum-spraying grinder in which material to be ground is sprayed by centrifugal force onto an impact surface.

A further object of the invention is to provide a grinder of the above type in which the disadvantages associated with the support, drive and guidance of the shaft of the rotor is overcome.

In accordance with the invention, there is provided a grinder comprising a fixed chamber, means connected to said chamber for connection to suction means, a target mounted in said chamber including a ring having an impact surface directed inwardly of the chamber, said impact surface having a vertical axis of symmetry of revolution and a rotor located at least partially in said chamber and defining an axis of rotation with said axis of symmetry of revolution of said impact surface of said target.

The rotor comprises an upper part in the form of a horizontal disc defining radial channels which communicate with a central orifice in the upper part of the disc and a lower part in the form of a vertical shaft for supporting and driving the rotor. The disc is located at the level of the target and inside the space defined by the impact surface thereof.

The invention contemplates the provision of a particular means for support, drive and guidance of the shaft rotor which comprises at least one active radial magnetic bearing comprising a stator surrounding said shaft over a part of the height thereof and a rotor carried by said shaft, an active axial magnetic stop comprising a movable part carried on the shaft and a fixed part located opposite said movable part of said stop, axial and radial position detectors for detecting the radial and axial position of said shaft, an electric motor comprising a stator surrounding said shaft over a part of the height thereof and a rotor mounted on said shaft, and ball bearing means mounted around said shaft and on which the shaft rests when it is not in operation.

BRIEF DESCRIPTION OF THE DRAWING

An embodiment of a grinder according to the invention will now be described, by way of example only, with reference to the accompanying drawing, in which.

DETAILED DESCRIPTION

Figure 1:
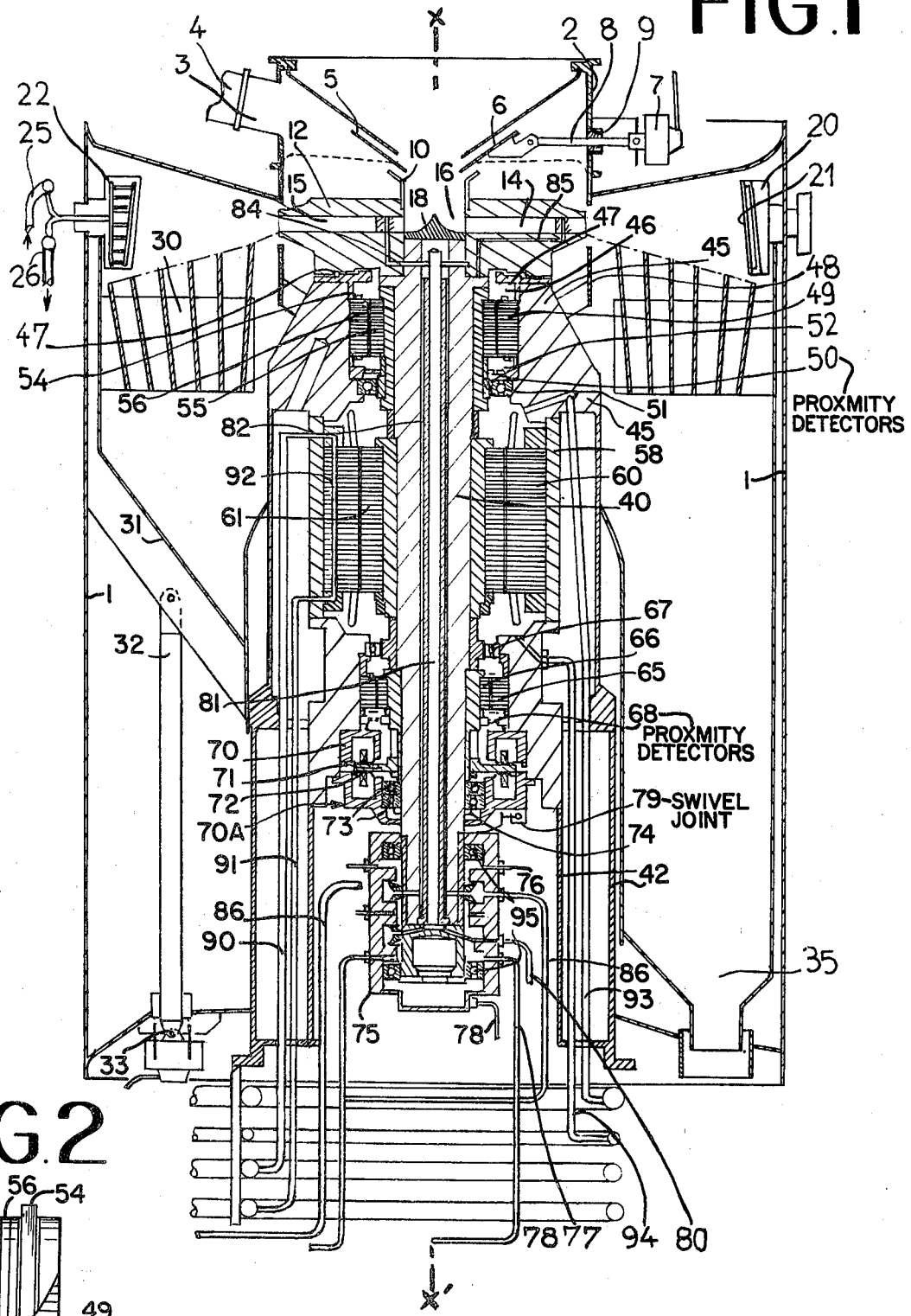
FIG. 1 is a vertical cross-section in a plane passing through the axis of rotation of the rotor, showing, in particular, the device for supporting, driving and guiding the rotor
Figure 2:
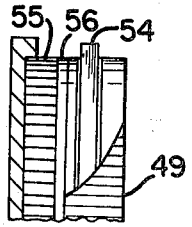
FIG. 2 is a partially broken away elevational view of the magnetic bearing in FIG. 1.

The grinder comprises a cylindrical chamber 1 having a vertical axis, in the upper part of which chamber is located a vertical pipeline 2, of large cross-section, having a branch 3 to which is fixed a pipeline 4 connected to a vacuum pump (not shown). A hopper 5 and vibratory support 6 therefor are located inside the pipeline 2.

The support 6 is connected to a vibrator 7 by means of a rod 8 which passes through a leakproof sliding gland 9 provided in an opening in the wall of the pipeline 2. Vibration of the support 6 and thereby of hopper 5 permits a uniform flow of the material to be ground.

The pipeline 2 is preceded by a lock-chamber (not shown) which allows the grinder to be fed while keeping the chamber under vacuum. In operation, a certain amount of material to be ground is introduced into the lock-chamber, which is isolated from the vacuum chamber. The lock-chamber is then placed under vacuum and in communication with the vacuum chamber so that the material flows from the lock-chamber into the hopper 5. During the operation of filling the lock-chamber and placing it under vacuum, the hopper 5 contains a sufficient amount of material to allow the installation to function continuously.

Below the vibrating support 6 there is a hopper 10 firmly fixed to a disc 12 which constitutes the upper part of the rotor. This disc is pierced with radial channels such as 14 and 15, there being six of these channels angularly spaced apart by 60° from one another. The hopper 10 terminates in an orifice 16 formed inside the disc 12 and communicating, at the level of a protuberance 18 which ensures the distribution of the granules to be ground, with the six channels in the disc 12.

The channels, such as 14 and 15, are lined with wear-resistant material.

Located in extension of these channels there is a target 20, which extends around the chamber, and whose impact surface 21 possesses symmetry of revolution about an axis coincident with the vertical axis XX' of the cylindrical chamber. This impact surface 21 is covered with a wear-resistant and impact-resistant material. Inside the body of the target are formed channels 22 for cooling of the target. A hose 25 introduces water into the channels 22 from outside the chamber, and a channel 26 discharges this water, which has circulated through the channels 22 so as to cool the body of the target.

Below the zone into which the particles to be ground will be sprayed, which is between the external peripheral surface of the disc and the target, there is located a set of deflectors 30 fixed to a hopper 31 connected via rods 32 to vibrators 33 located outside the vacuum chamber and serving to vibrate the hopper 31, the function of which is to collect the ground pulverulent material so as to pass the material to the outlet 35 of the hopper 31, connected to a vacuum lock-chamber unit to allow the product to flow out of the chamber without breaking the vacuum.

The disc 12 which constitutes the upper part of the rotor of the grinder is firmly fixed to a tubular cylindrical elongated shaft 40, the diameter of which decreases from its upper part to its lower end.

The axis of the shaft 40 is the axis XX' of the vacuum chamber which is also the axis of revolution of the impact surface 21 of the target 20.

Around the shaft 40 is located a cylindrical double jacket 42 fast with the fixed chamber, which jacket forms the inner wall of the chamber and permits the attachment of the fixed members which surround the rotor.

To the upper part of the double jacket 42 is fixed a frusto conical supporting member 45 pierced with a central bore 46 and carrying, at its upper part, a joint 47 which cooperates with the lower surface of the disc 12 so as to form a labyrinth which partially isolates the part of the chamber, where the grinding and the recovery of the pulverulent materials takes place, from the chimney, formed in the chamber by the double jacket 42, inside which are located the rotor and the devices for guiding and supporting the rotor. The support 45 also carries a cylindrical screen 48 which makes it possible partially to isolate the joint 47 from the dusty atmosphere prevailing in the chamber.

Inside the bore 46 in the support 45 are located the tubular stator 49 of a radial magnetic bearing, proximity detectors 50 which detect the radial position of the rotor 40, and a ball bearing 51 whose inner ring surrounds the rotor 40 with play 52, allowing the rotor to revolve without contacting the inner ring.

The stator 49 of the magnetic bearing consists of a stack of soft iron rings which, when assembled, form a foliated tube inside which are located coils 54 for creating magnetic fields in the gap 56 between the stator 49 and a rotor 55 of the magnetic bearing. The rotor 55 consists of a stack of rings of soft iron firmly fixed to the rotor 40. The width of the gap 56 between the stator and the rotor of the radial magnetic bearing thus formed is of the order of 5 to 10 mm.

The upper part of the internal jacket 42 of the fixed chamber is firmly fixed to a support 58 connected, at its upper part, to the support 45. The support 58 is in the shape of a body of revolution and surrounds the shaft 40 over its entire length. The support 58 carries the stator 60 of a drive motor of the rotor, which stator consists of a stack of soft iron rings assembled in the form of a foliated tubular member inside which are formed recesses for locating the coils of the stator.

A supply of current creates a rotating field which causes the shaft to rotate at a very high speed; the part of the shaft opposite the stator 60 carries a foliated rotor 61. Between the stator 60 and the rotor 61 is a gap of a width of the order of 5 to 10 mm. Inside the stator 60 of the drive motor of the rotor 40, a cooling circuit permits water to circulate at a high flow rate, thereby making it possible to maintain this stator at a moderate temperature in spite of the very high supply current intensities.

The support 58 also carries the stator 65 of a second radial bearing whose rotor 66 is carried by the shaft 40 in a part where this shaft has a diameter less than that of the upper bearing 49–55. The magnetic bearing 65–66 is in all respects identical to the bearing 49–55 except that its size is smaller. The gap between the stator 65 and the rotor 66 is again of the order of 5 to 10 mm. The bearing 65–66 is associated with a ball bearing 67 whose internal ring provides a certain play around the rotor 40, and which a set of proximity detectors 68 which allow the radial location of the shaft 40 to be detected.

The support 58 carries, on its lower part, the fixed part or stator 70 of an axial magnetic stop 70A composed of a magnetic circuit and a coil. The rotor 40 carries a magnetic member 71 spaced by a gap 72 from the stator 70 for supporting the entire weight of the rotor 40 under the effect of axial magnetic forces compensating the weight of the shaft 40 and of the disc 12 which compose the rotor of the grinder. A ball bearing 73 is located on the part of the shaft 40 which is opposite the base of the stator 70, and when the magnetic stop 70A is supplied with current the bearing 73 is raised very slightly above the lower part 74 of the stator 70 which forms a mechanical stop with the ball bearing 73 for holding the rotor axially when the magnetic stop 70A is not supplied with current. The base of the shaft 40 extends into a rotary gland 75 which receives the pipelines for the cooling fluid for the various members of the grinder. This rotary gland is located outside the grinder chamber, the shaft 40 being mounted so as to rotate in this bearing by means of two ball bearings 95 lubricated by means of oil supply pipelines 76 and 77.

The lubricating oil for these ball bearings is removed through a pipeline 78.

The use of mechanical bearings on this part of the shaft is made possible by the fact that here the shaft has a very small cross-section and its peripheral speed is thus less than that of the parts of the shaft of large diameter which are held by magnetic bearings, and that furthermore the ball bearings 95 are located in air and can be lubricated by a mist of oil by means of a separate circuit, making it possible to use the bearings at high speed without excessive wear.

The rotary gland 75 is fixed to the base of the support 58 by a swivel joint 79.

In addition to the pipelines for the circulation of the lubricating oil of the bearings 95, the rotary gland 75 is connected to the pipelines which allow cooling fluid to circulate inside the rotor; this fluid enters through a pipeline 80 which feeds a tube 81 located in the central part of the tubular rotor 40, the tube 81 being coaxial with the rotor and forming an annular channel 82 between the internal bore of the shaft 40 and the external surface of this tube. The cooling fluid which enters through the pipeline 80 flows through the tube 81, is distributed through the body of the disc 12 by means of channels 84 of small diameter and cools the disc by circulating radially through channels formed in the disc 12 and returning through other radial channels 85 for the return of the fluid through the external annular space 82 formed between the rotor and the tube 81. The cooling fluid is then discharged through channels 86.

There is also a water cooling circuit for the stator 60 of the drive motor of the shaft 40, which circuit comprises a feed pipeline 90 and a return pipeline 91, between which are located stator cooling pipelines such as 92.

In addition, two pipelines 93 and 94, connected to suction means, are introduced between the two parts of the internal jacket 42 of the grinder chamber and communicate with the interior of the support 58 to create a vacuum inside the leakproof support 58 above and below the drive motor of the shaft 40.

It will be seen that the internal part of the grinder chamber, which surrounds the shaft 40 over the greater part of its length and which is defined by the supports 58 and 45 supported by the two parts of the jacket 42 is not entirely leakproof because the shaft 40 passes, with a certain amount of play, through the base of the support 58. There is thus a very slight leakage around the shaft 40, which leakage is limited by several labyrinth stages consisting firstly of the gland 47, and of the successive gaps of the magnetic bearings and of the magnetic stop 70A. It is one of the advantages of the magnetic bearings used for guiding and supporting the rotor that they form labyrinths for controlling the leakages along the rotor, the leakproofness of the stators being achieved by filling the voids of these stators with a durable glue of the Araldite type.

The leakages are therefore extremely slight and it is possible to maintain a vacuum of the order of 0.5 mm Hg in the chamber during operation of the grinder.

The coils of the stators of the magnetic bearings and magnetic stop are supplied with current by means of an electronic control circuit which receives, as information, the outputs of the radial and axial position detectors which indicate the variations in the position of the shaft 40 during its rotation. If the detectors record an off-center position of the shaft resulting, for example, from unbalance of this shaft, for instance due to wear of the channels of the disc 12 in the course of operation, the electronic control circuit will alter the current supply to the various coils of the stators so as to keep the shaft rotating inside the gap of the bearings. The electronic control circuit makes it possible at all times to maintain the shaft 40 and the disc 12, which constitute the rotor, in rotation about its axis of inertia and not about its axis of geometrical symmetry. This in particular makes it possible to compensate an unbalance of the shaft resulting, for example, from unsymmetrical wear of the channels formed in the disc 12. As this correction relates to a very slight shift of the rotor, it is of course only possible within the limit of the width of the gaps of the bearings, but we have seen that this gap is of relatively large width (5 to 10 mm) which makes it possible to correct relatively large balancing defects.

The operation of the above described grinder will now be described. When the grinder is stopped, that is to say the rotor is not moving and rests via the ball bearing 73 on the part 74 of stator 70, the rotor occupies a slightly inclined position which causes it to be supported on the inner ring of the ball bearings 67 and 51. The setting up of a vacuum in the chamber of the grinder is first started and then the magnetic stop 70A the bearings 65–66 and 49–55, followed by the stator of the motor 60, are supplied with current. The rotor is thus raised in the magnetic stop 70A above the part 74 of stator 70 by the magnetic forces and is kept vertical by the radial bearings. Excitation of the stator of the motor causes it to rotate without any contact with the mechanical bearings on which the rotor rested when it was in the nonoperating position. The hopper 5 is fed with a first charge of granulated material contained in the lock-chamber which is kept under vacuum, and the hopper 5, caused to vibrate, feeds the hopper 10 and the interior of the disc 12, at a uniform rate, with material to be ground, in the form of granules, for example of cement clinker. The size of the channels formed in the disc 12 is so chosen that the largest particles likely to be encountered in the mixture to be ground cannot block these channels.

In the case of cement clinker, the disc is caused to rotate at a speed of 7,000 revolutions/minute and the clinker is fed to the rotor at a rate of the order of 25 t/hour. Each of the particles which penetrates into the channels is ejected at a very high speed in the direction of the target, on the impact surface 21 of which the particles are crushed to a fine powder of the desired particle size. The powder obtained flows via the deflectors 30 and the hopper 31, set in motion by the vibrators 33, towards the outlet 35 of the hopper 31, where the material accumulates.

In the course of operation of the grinder, the readings of the position detectors make it possible to control, by means of the electronic circuit for the current supply to the stators, the magnetic bearings which keep the shaft perfectly centred, if its balance is also perfect, or slightly offset and rotating about its axis of inertia, which is then different from the geometrical axis, if unbalancing of the rotor has occurred. During the operation of the grinder, suction is maintained through the pumping pipeline 3, which creates a slight leak through the labyrinth 47 and the gaps of the magnetic bearings and magnetic stop.

The lock-chamber for feeding the hopper 5 is filled while the hopper empties into the rotor of the grinder, that is to say without stopping the apparatus, by isolating the lock-chamber from the hopper inlet, by breaking the vacuum in this lock-chamber and by filling it with material to be ground, the lock-chamber then being closed and brought back under vacuum. This lock-chamber can thus periodically feed the hopper 5. In the same way, the lock chamber located at the outlet of the hopper 35 is emptied periodically without interrupting the operation of the grinder. The operation is thus completely continuous.

If, by reason of an accident, the magnetic suspension of the rotor revolving at high speed failed, the rotor would fall back on to the ball bearings 51–67 and 73, making it possible to brake the rotor and hold it until it stops completely. This can obviously result in complete destruction of the ball bearings which are caused to operate for a very short time at a very high speed, but these components can easily be replaced and avoid destruction of the rotor in the case of a fault.

The operation of the grinder can continue for very long periods, for example of the order of 10 hours and more, without excessive heating of the parts which are in frictional contact with the particles, and without unbalance due to the wear of the rotor causing a stoppage of the installation. In addition to the advantages inherent in them in application to the device which has just been described, the magnetic bearings have the advantage, as in any other vacuum device in which they are used, that they eliminate the risk of introducing oil into the vacuum chamber, that they function silently and without excessive heating and that they are of at least equivalent tightness, for a lower power consumption, with respect to, for example, the hydrostatic bearings. These bearings furthermore have a high damping power, which reduces the risk of causing the supports to vibrate.

There is thus provided a grinder which can function in spite of a slight unbalance of the rotor and which can function with a low power consumption, without vibration and with very little temperature rise at the bearings.

The invention is not limited to the embodiment which has just been described. On the contrary, it comprises all the variants, and can be modified in points of detail without thereby going outside the scope of the invention.

Thus it is possible to use, in place of two radial bearings located on either side of the drive motor, as in the embodiment which has just been described, a single radial bearing of greater length. It is also possible to combine the magnetic bearings with hydrostatic or mechanical bearings located, for example, on a portion of the shaft which is outside the vacuum chamber. It is obviously possible to use cooling devices different from those employing liquid circulation which have been described, and mechanical stops, for support and assistance, of a different type from that which has just been described. The above described grinder is equally suitable for the grinding of cement clinker as for the grinding of minerals or any other operation where it is desired to obtain fine powder from materials in the form of granules or flakes or in any other form which allows the material to be ground to pass continuously through the inside of the ejection rotor.

What is claimed is:

1. A vacuum-spraying grinder in which material to be ground is sprayed by centrifugal force on to an impact surface, said grinder comprising:

a fixed chamber;

means connected to said chamber for connection to suction means so that the chamber is under suction pressure;

a target mounted in said chamber comprising a ring having an impact surface directed inwardly of said chamber, said impact surface having a vertical axis of symmetry of revolution;

a rotor located at least partially in said chamber and defining a vertical axis of rotation coincident with said axis of symmetry of revolution of said impact surface of said target, said rotor comprising an upper part in the form of a horizontal disc defining radial channels which communicate with a central orifice provided in the upper part of said disc, and a lower part in the form of a vertical shaft for the support and drive of said rotor, said disc being located at the level of said target and inside the space defined by said impact surface thereof;

means for feeding material to be ground to said central orifice of said disc and permitting continuous feeding of said grinder;

means for removing ground material from the lower end of said vacuum chamber; and means for supporting, driving and guiding said shaft of said rotor comprising:

at least one active radial magnetic bearing comprising a stator surrounding said shaft over a part of the height thereof, and a rotor carried by said shaft in spaced relation with said stator;

an active axial magnetic stop comprising a movable part carried on said shaft and a fixed part located in spaced relation opposite said movable part of said stop;

radial and axial position detector means for detecting the radial and axial positions of said shaft, said detector means being connected to circuit means for controlling the energization of said stator of said magnetic bearing and said magnetic stop in accordance with output signals from said detector means to compensate any unsymmetrical wear of said rotor by shifting of the rotor within the space between the stator and rotor of the radial magnetic bearing;

an electric motor comprising a stator surrounding said shaft over a part of the height thereof and a rotor mounted on said shaft in spaced relation with said stator; and ball bearing means, mounted around said shaft and on which said shaft rests when it is not in operation.

2. A grinder according to claim 1, wherein said means for supporting said shaft comprises two magnetic bearings one located on each side of said drive motor in the axial direction of said shaft.

3. A grinder according to claim 1, wherein said shaft extends in a vertical chimney which is laterally leakproof and is defined within said chamber by fixed support means for supporting said stators of said bearing and of said motor, said support means being fixed to said chamber, said support means terminating outside the lower end of said chamber, said shaft constituting with said support means a set of labyrinth joints.

4. A grinder according to claim 1, wherein said shaft extends outside said chamber over a part of its length and is surrounded, in said external part, by a rotary gland for feeding said rotor with cooling fluid.

5. A grinder according to claim 4, wherein said rotary gland comprises a leakproof double ball bearing comprising an inner ring fixed to said shaft and an outer ring which receives feed pipelines for the cooling fluid and channels for supplying lubricant to said ball bearing of the rotary gland.

6. A grinder according to claim 1, wherein said shaft is tubular having a central bore and a coaxial tube is fixed in said bore to form a channel of annular cross-section between the internal surface of said bore and the external surface of said tube, means being provided for circulating fluid for cooling said rotor in opposite directions in the interior of said tube, and in said annular channel.

7. A grinder according to claim 1 comprising means for cooling said target, deflector means in said chamber for guiding particles ground by said impact surface to said removing means, and jacket means surrounding said shaft and including an inner wall and fixed support supporting said stator of the magnetic bearing, the fixed part of the magnetic stop, the detector means, and the stator of the electric motor.

8. A grinder according to claim 7 wherein said jacket means further comprises an outer wall forming an inner surface of said fixed chamber.

* * * * *